US005278364A

United States Patent [19]

Misawa et al.

[11] Patent Number: 5,278,364

[45] Date of Patent: Jan. 11, 1994

[54] ROTARY SWITCH

[75] Inventors: Fumihiro Misawa; Kenichi Nakajima, both of Suwa, Japan

[73] Assignee: Seiko Epson Corporation, Tokyo, Japan

[21] Appl. No.: 901,093

[22] Filed: Jun. 19, 1992

[30] Foreign Application Priority Data

Jun. 21, 1991 [JP] Japan ..... 3-150314
Apr. 3, 1992 [JP] Japan ..... 4-082292

[51] Int. Cl.[5] ..... H01H 21/00; H01H 3/40
[52] U.S. Cl. ..... 200/11 R; 200/17 R
[58] Field of Search ..... 200/11 R, A 11 DA, 11 GK, 11 TW, 11, 18

[56] References Cited

U.S. PATENT DOCUMENTS 3,754,106 8/1973 MacDonald ..... 200/14

FOREIGN PATENT DOCUMENTS 63-77177 5/1988 Japan ..... F16K 31/04
3-55624 5/1991 Japan ..... H01H 19/20

*Primary Examiner*—Howard L. Williams
*Assistant Examiner*—Michael A. Friedhofer
*Attorney, Agent, or Firm*—Oliff & Berridge

[57] ABSTRACT

A rotary switch permits the interrelation between the angle of rotation of a rotary switch knob and the angle of integral rotation of a rotor and a contact spring to be set as desired. A rotary switch knob and a rotor are respectively provided with a first gear and a second gear, and are linked together by these gears. The rotor carries a contact spring fixed thereto. When the ratio between the respective teeth numbers of the first and second gears is suitably set, the interrelation between the rotational angle of the rotary switch and that of the rotor and the integral contact spring can be set as desired.

21 Claims, 6 Drawing Sheets

ROTARY SWITCH

BACKGROUND OF THE INVENTION

1. Field of the Invention

The present invention relates to rotary switches which may be used in electronic equipment or the like.

2. Description of the Related Art

An example of a conventional rotary switch is shown in FIG. 10. This rotary switch includes a case 1, a rotary switch knob 2, a rotor 3, and a contact spring 9. The rotary switch knob 2 is rotatably mounted on the case 1 by an E-shaped retaining ring 5. The rotor 3 is directly linked to the rotary switch knob 2 by attaching the rotor 3 to the knob 2. The contact spring 9 is attached to rotor 3 by, for example, heat caulking or an equivalent method. When the rotary switch knob 2 is rotated through an angle, the rotor 3 together with the contact spring 9 rotate through an equal angle.

Thus, with the conventional rotary switch, the rotary switch knob 2 and the rotor 3 are directly linked with each other because they are fitted together, or fixedly attached to each other by an equivalent method. Accordingly, the angle of rotation of the rotary switch knob 2 and the rotor 3 and integral contact spring 9 are always the same. This is, however, disadvantageous for a number of reasons.

When two or more circuits have to be formed along a common circumference, the rotary switch knob 2 must be restricted from rotating beyond 180° (the maximum range of a single circuit in a circumference containing two equal sized circuits) because 180° is the maximum range of a single circuit in a switch using two or more circuits. This limits the freedom of design of the switch.

Conversely, when the angle range within which the rotary switch knob 2 can be rotated (per circuit) is set at a certain angular quantity, then this set quantity determines the number of circuits which can be formed along a common circumference. (For example, if the angle range of knob 2 is 120°, then three circuits can be formed along a common circumference.) As a result, when the rotational angle range of knob 2 is great, and the number of circuits along the circumference is also great, it may be necessary to increase the number of circuit blocks. This results in the rotary switch structure being complicated, and having a great size.

On the other hand, when a large number of contacts have to be provided per circuit, it is necessary to reduce the pitch (the angle between adjacent contacts) at which a pattern is formed on a printed circuit board. This means that the pitch (the angle between adjacent positions) at which the rotary switch knob 2 rotates for switching must be accordingly reduced.

OBJECT AND SUMMARY OF THE INVENTION

With a view to overcoming the above-described problems, an object of the present invention is to provide a rotary switch which permits the pitch of switching rotation of the rotary switch knob (i.e., the angle between adjacent positions of the switch knob) to be freely set independently of the number of circuits, the number of necessary contacts, or the pitch of the contacts in the pattern on the associated printed circuit board.

In order to achieve the above and other objects, and to overcome the shortcomings set forth above, a rotary switch according to the present invention includes gears provided in a section of the switch where driving force is transmitted from the rotary switch knob to the rotor.

With the above arrangement of the present invention, when a pair of gears provided in the driving-force transmitting section between the rotary switch knob and the rotor have mutually different numbers of teeth, it is possible to attain a difference in the angle of rotation between the rotary switch knob, on one hand, and the rotor and associated contact spring, on the other hand.

BRIEF DESCRIPTION OF THE DRAWINGS

The invention will be described in detail with reference to the following drawings in which like reference numerals refer to like elements and wherein.

DETAILED DESCRIPTION OF THE PREFERRED EMBODIMENTS

Embodiments of the present invention will now be described with reference to the drawings.

Figure 1:
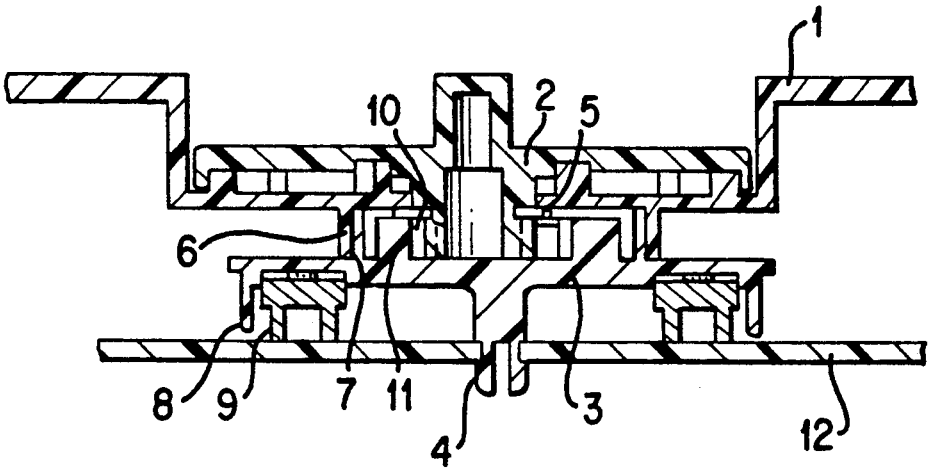
FIG. 1 is a sectional view of a rotary switch according to the present invention.

Referring to FIG. 1, which is a sectional view of a rotary switch according to the present invention, a rotary switch knob 2 is rotatably mounted on an upper case 1 by an E-shaped retaining ring 5. A rotor 3 is rotatably mounted on a printed circuit board 12 by an engagement pawl 4 integrally formed on the rotor 3. Ribs 6 and 7, respectively provided on the case 1 and the rotor 3, have dimensions appropriate for regulating the play of the rotor 3 with respect to the case 1. Specifically, ribs 7 are located radially inward of ribs 6 so as to align rotor 3 for rotation relative to case 1. A contact spring 9 is fixed to rotor 3 by, for example, heat caulking so that contact spring 9 rotates with rotor 3. The rotor 3 is provided with another rib 8 for regulating the inclination of rotor 3 relative to case 1 and to printed circuit board 12.

A first gear 10 is provided on an axial portion (drive shaft) of the rotary switch knob 2. A second gear 11 (which functions as a driven gear) is provided on rotor 3. Gears 10 and 11 mesh with each other so that rotary motion of the rotary switch knob 2 is transmitted to the rotor 3.

When the ratio of the number of teeth (teeth number ratio) between the first and second gears 10 and 11 is set to a value other than 1, it is possible to attain a difference between the angle of rotation of the rotary switch knob 2 and the angle of rotation of rotor 3 and integral contact spring 9.

Figure 2:
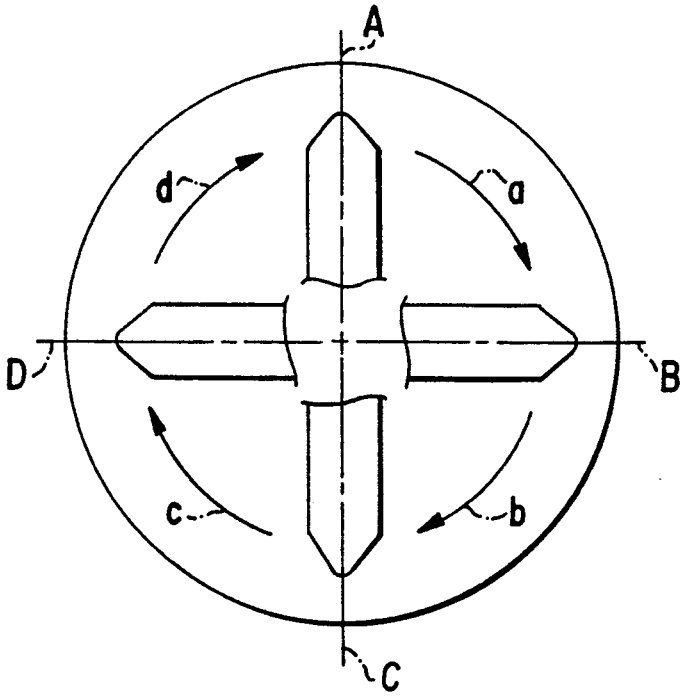
FIGS. 2 and 3 are plan views of a rotary switch according to the present invention.

The present invention will be described with reference to FIGS. 1 through 3 with respect to an example of a rotary switch formation having two circuits and four contact positions in correspondence with a single circumference.

Figure 3:
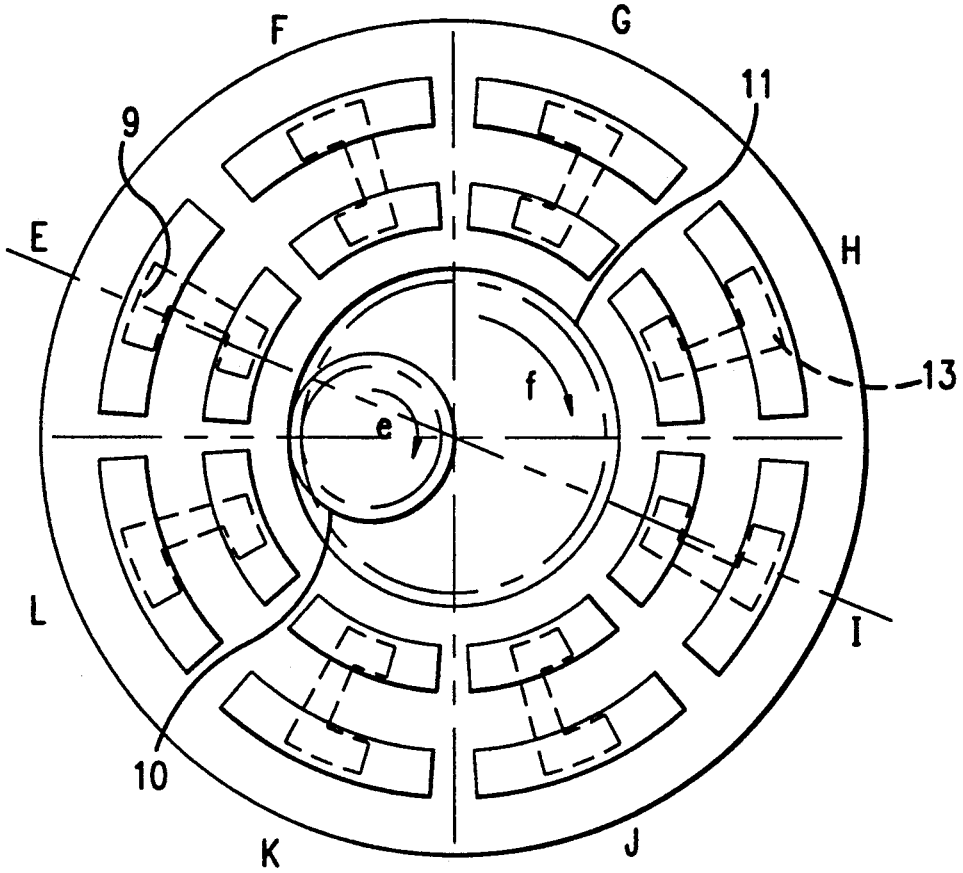

As shown in FIG. 3, a one-circuit four-contact-point switch having contact points E, F, G and H, and another one-circuit four-contact-point switch having contact points I, J, K and L are formed along a common circumference on the associated printed circuit board. Rotor 3 carries a pair of contact springs fixed thereto. In particular, a contact spring 9 for causing conduction at any one of the contact points on the corresponding pattern on the printed circuit board, and a contact spring 13 located at a diametrically opposite position to the contact spring 9 are provided on rotor 3. A first gear 10 having, for example, ten teeth is provided on an axial portion (drive shaft) of the rotary switch knob 2. A second gear 11 having, for example, twenty teeth is provided on the rotor 3. Accordingly, in this example, gears 10 and 11 have a teeth number ratio of 1:2.

When the rotary switch knob 2 is rotated from position A to position B (both shown in FIG. 2) in the direction indicated by the arrow a (shown in FIG. 2), the first gear 10 rotates 90° in the direction indicated by the arrow e in FIG. 3, causing the second gear 11 to rotate in the direction indicated by the arrow f. Because the teeth number ratio between the first and second gears 10 and 11 is 1:2, rotor 3 rotates 45°. Accordingly, the contact springs 9 and 13 fixed to rotor 3 also rotate 45°, respectively moving from contact point E to contact point F and from contact point I to contact point J, thereby performing a switching action. Similar amounts of rotation (45°) are caused in rotor 3 for each 90° rotation of knob 2 in the direction of arrows b, c and d from position B to position C, C to D, and D to A, respectively, to move contacts 9 and 13 to contact points G and K, H and L, and E and I respectively. Thus rotating knob 2 by 360° causes rotor 3 to rotate by 180°.

Thus, the above embodiment permits a one-circuit four-contact pattern having an angular span of 180° to be repeated to form two (180°) circuits along a common circumference of 360°. Even in this case, it is possible to make the rotary switch knob 2 rotatable within an angle range of 360°, and effect switching through 180°. In previous devices, knob 2 would have been restricted to 180° of rotation for a similar circuit pattern. Accordingly, the four knob positions had to be grouped within 180° instead of the full 360° available around knob 2.

An embodiment of a rotary switch according to the present invention which is incorporated in a multi-function meter now will be described.

Figure 4:
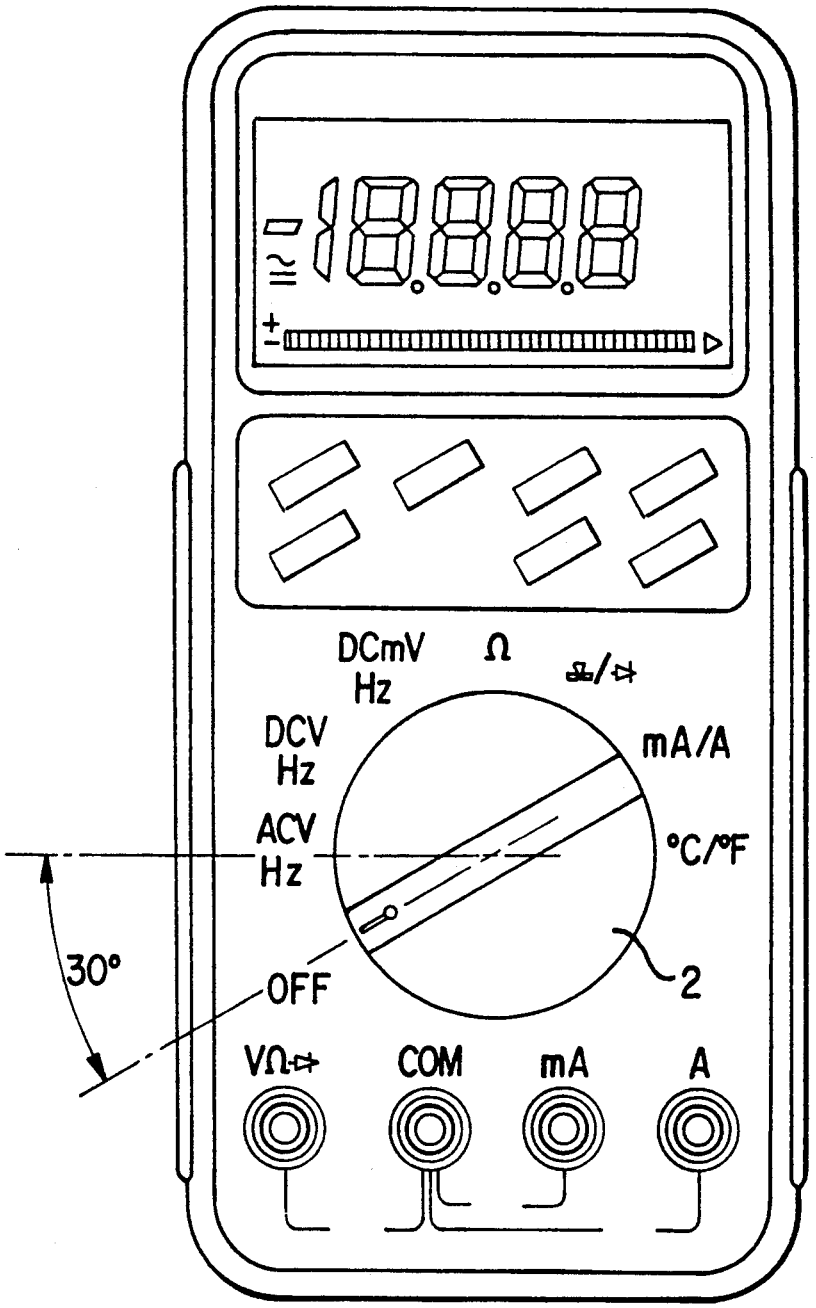
FIG. 4 is a view showing the external appearance of a multi-function meter incorporating a rotary switch according to the present invention.

FIG. 4 shows the external appearance of such a multi-function meter. In the multi-function meter, when the rotary switch knob 2 is operated, it is possible to switch to a particular function selected from among various functions available for the purpose of measurement. There are eight possible positions of the rotary switch which correspond to the various functions, namely, a position for turning OFF the power supply and seven other positions for providing the functions of measuring ACV, DCV, DCmV or Ω, checking conduction, and measuring DC/AC A or temperature are provided. These positions, indicated by suitable symbols, are arranged around a circular circumference in the above order at an angular interval of 30°. This 30° interval corresponds to the pitch of position switching, and is determined from the viewpoint of enabling good operability and appropriate design of character arrangement. Thus, the maximum possible angle of rotation of the rotary switch knob 2, which corresponds to the range from the "power OFF" position to the "temperature measurement" position, is 210°.

Figure 5A:
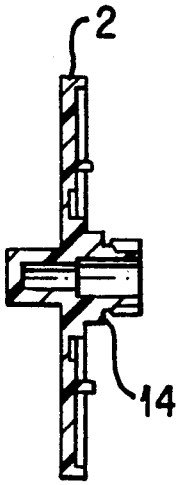
FIGS. 5A and 5B show a sectional view and a plan view, respectively, of a rotary switch knob of a rotary switch according to the present invention.
Figure 5B:
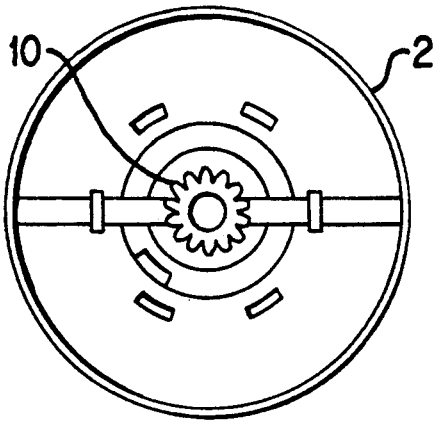

FIGS. 5A and 5B show a sectional view and a plan view, respectively, of a rotary switch knob of a rotary switch according to the present invention. A gear 10 is provided on an axial shaft portion of the rotary switch knob. The gear 10 has a module (teeth size) of 0.5 mm, and has fourteen teeth. The axial shaft portion is formed with a groove 14 for receiving an E-shaped retaining ring by which the rotary switch knob is rotatably mounted on the associated upper case.

Figure 6A:
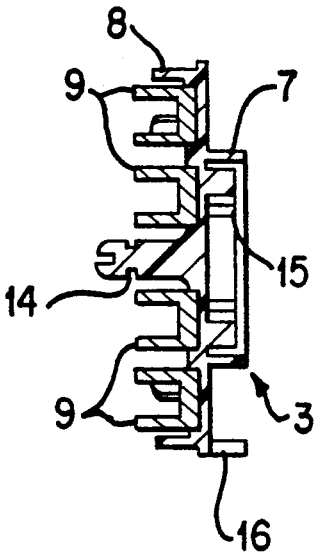
FIGS. 6A and 6B show a sectional view and a plan view, respectively, of a rotor of a rotary switch according to the present invention.
Figure 6B:
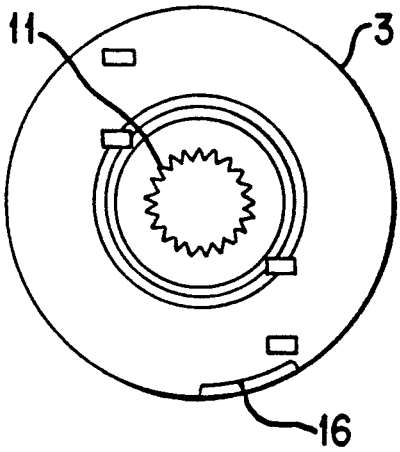

FIGS. 6A and 6B show a sectional view and a plan view, respectively, of a rotor of a rotary switch according to the present invention. An internal gear 11 is provided on the rotor. That is, the teeth of gear 11 face inwardly toward the axis of rotation of rotor 3. The gear 11 has a module (teeth size) of 0.5 mm, and has twenty one teeth. The gear 11 has a taper portion 15 for making smooth the meshing of gear 11 with gear 10 of the rotary switch knob 2, and for preventing breakage of the teeth of the gears 10 and 11 upon abutment with each other. The rotor carries four contact springs 9 fixed thereto. An axial shaft portion of the rotor is formed with a groove 14 for receiving an E-shaped retaining ring by which the rotor is rotatably mounted on the associated printed circuit board. A rib 16 is provided for the purpose of switch position alignment. Specifically, the rib 16 is located at a certain position of the rotor at which the rotor, when being mounted onto the printed circuit board, abuts on the associated housing when the rotor is mounted in its "power OFF" position. The rib 16 thus serves to attain switch position alignment upon assembly of, for example, the multi-function meter of FIG. 4.

Figure 7:
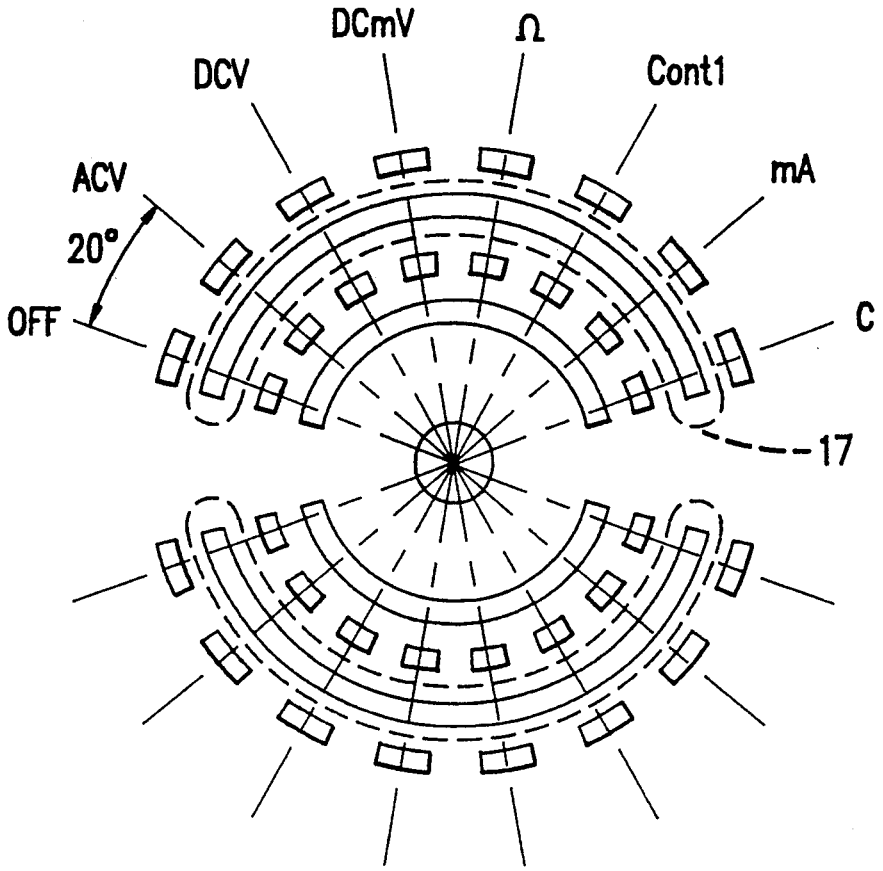
FIG. 7 is a plan view of a switch circuit formed on a printed circuit board of a multi-function meter incorporating a rotary switch according to the present invention.

FIG. 7 is a plan view of a switch circuit formed on a printed circuit board of the FIG. 4 multi-function meter incorporating a rotary switch according to the present invention. A one-circuit eight-contact switch 17 has an angular interval of 20° between each pair of adjacent contacts. Accordingly, the angle range from the "power OFF" position to the "temperature measurement" position is 140°. This enables another one-circuit eight-contact switch to be formed along the remaining portion of the circumference containing switch 17. (Whereas, if the 30° pitch of the positions for knob 2 were used for switch 17, this would not be possible because switch 17 would span 210°.) Since the multi-function meter requires four one-circuit eight-contact switches, another pair of one-circuit eight-contact switches are provided inside the above pair.

Figure 8:
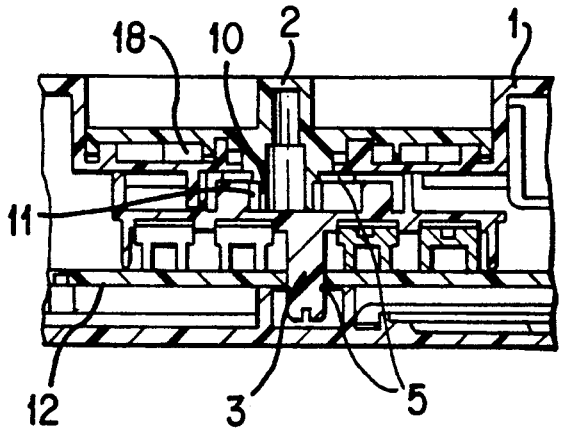
FIG. 8 is a sectional view of a multi-function meter incorporating a rotary switch according to the present invention.

FIG. 8 is a sectional view of the FIG. 4 multi-function meter incorporating a rotary switch according to the present invention. A rotary switch knob 2, provided with a first gear 10, is rotatably mounted on an upper case 1 by an E-shaped retaining ring 5. A click rotor 18 is placed between the rotary switch knob 2 and the upper case 1. The thus interposed click rotor 18 provides a clicking action each time an angular interval of 30° is covered during rotation of knob 2. A rotor 3, provided with a second gear 11, is rotatably mounted on a printed circuit board 12 by another E-shaped retainer ring 5. During assembly, when the printed circuit board 12 with the rotor 3 mounted thereon is set onto the upper case 1 with the knob 2 mounted thereon, the first and second gears 10 and 11 are brought into meshing engagement with each other. At this time, a rib 16, such as that described above, of the rotor 3 is used to align the rotor 3 with its "power OFF" position. The rotary switch knob 2 is also brought to its "power OFF" position, thereby completing the position alignment of the rotary switch knob 2 and the rotor 3.

The first gear 10 of the rotary switch knob 2 has fourteen teeth, while the second gear 11 of the rotor 3 has twenty one teeth. The gears 10 and 11 therefore have a teeth number ratio of 2:3.

In the above-described example, when rotary switch knob 2 is rotated through an angle of 30°, since the teeth number ratio of the gears is 2:3, rotor 3 rotates through a corresponding angle of 20°. The rotation of the rotor 3 causes contact springs 9, fixed to the rotor 3, to move from some to others of a plurality of contacts of a switch circuit formed on the printed circuit board and having an angular interval of 20° between two adjacent contacts, so as to effect switching.

The above embodiment may be such that the rotary switch knob 2 is rotatable through an angle range of more than 180°. Even in this situation, it is possible to form two circuits (each extending for no more than 180°) along a common circumference, thereby making it possible to reduce the size of the rotary switch.

Another embodiment of the present invention will be described, in which both the rotary switch knob and the rotor have mutually engageable external gears.

Figure 9:
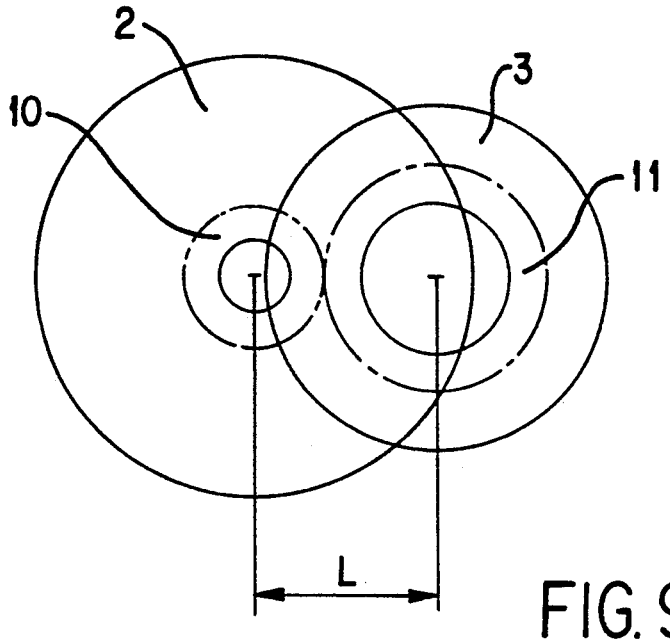
FIG. 9 is a view showing the meshing engagement between external gears of a rotary switch according to an alternative embodiment of the present invention.
Figure 10:
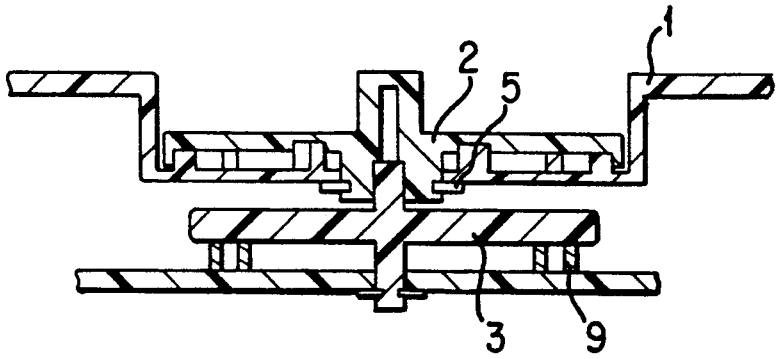
FIG. 10 PRIOR ART
FIG. 10 is a sectional view of a conventional rotary switch.

Referring to FIG. 9, a first gear 10 of the rotary switch knob 2 meshes with a second gear 11 of the rotor 3. The distance L between the center of the rotary switch knob 2 and the center of the rotor 3 can be expressed by the following formula, in which m represents the module (teeth size), Z1 represents the number of teeth of the first gear 10, and Z2 represents the number of teeth of the second gear 11:

$$L=m(Z1+Z2)/2$$

When gears are provided in the driving-force transmitting section between the rotary switch knob 2 and the rotor 3, an offset L thus occurs between the respective centers of the knob 2 and the rotor 3. The center of the rotor 3 can be positioned at any point along the circumference defined around the center of the rotary switch knob 2 as long as the center-to-center distance of L is provided.

As will be understood from the above formula, the distance L between the respective centers of the rotary switch knob 2 and the rotor 3 can be varied as desired by suitably varying the module (teeth size) m, the teeth number Z1, and/or the teeth number Z2. Accordingly, when the position of the rotary switch knob 2 on a case 1 has been determined, the rotor 3 can be positioned optimally for facilitating wiring from the relevant switch circuit and the arrangement of various component parts. Thus, it is possible to increase the freedom of design of the overall device.

As has been described above, according to the present invention, a simple structure including gears provided on a rotor and a rotary switch knob enables the angular pitch at which the rotary switch effects switching to be freely set independently of the number of circuits formed along a common circumference on a printed circuit board, or the number and spacing of contacts provided therein. Furthermore, suitable selection of the gear specifications, the gear radii, and the position of gear meshing-engagement enables the respective center positions of the rotary switch knob and the rotor to be varied as desired. Thus, it is possible to increase the freedom with which external appearance as well as the printed circuit board can be designed.

Although the described preferred embodiment uses gears to form a transmission between the rotary switch knob and the rotor to permit these elements to rotate relative to each other, other arrangements are possible. For example belts and pulleys could also function as a transmission between the rotary switch knob and the rotor.

While this invention has been described in conjunction with specific embodiments thereof, it is evident that many alternatives, modifications and variations will be apparent to those skilled in the art. Accordingly, the preferred embodiments of the invention as set forth herein are intended to be illustrative, not limiting. Various changes may be made without departing from the spirit and scope of the invention as defined in the following claims.

What is claimed is:

1. A rotary switch comprising:

a switch knob; a first gear fixedly attached to said switch knob; a rotor; a second gear fixedly attached to said rotor; and contact spring means attached to said rotor; said first and second gears engaging each other so that said switch knob and said rotor are rotatably attached to each other by said first and second gears, whereby a driving force is transmitted from said switch knob to said rotor through said gears, said first gear having a lesser number of gear teeth than said second gear for an equal angle of rotation of said first and second gears so that rotation of said switch knob through a first angle causes rotation of said rotor through a second angle less than said first angle.

2. The rotary switch of claim 1, wherein said first gear has less gear teeth than said second gear.

3. The rotary switch of claim 1, further comprising a circuit board having a circuit pattern thereon, said rotor being rotatably mounted to said circuit board so that said contact spring means is selectively movable between and contactable with a plurality of contacts in said circuit pattern.

4. The rotary switch of claim 3, wherein said circuit pattern includes two circuits arranged along a common circumference on said circuit board, each of said two circuits extending along no more than 180° of said common circumference, and rotation of said rotor through 180° so as to selectively engage said contact spring means with said plurality of contacts in said two circuits is caused by rotation of said switch knob through an angle greater than 180°.

5. The rotary switch of claim 3, wherein an angle between adjacent contacts in said circuit pattern is less than an angle between adjacent positions of said switch knob.

6. The rotary switch of claim 1, wherein the gear teeth on said first gear extend radially outward from a rotation axis of said switch knob, and the gear teeth on said second gear extend radially inwardly toward a rotation axis of said rotor.

7. The rotary switch of claim 1, wherein the gear teeth on said first gear extend radially outward from a rotation axis of said switch knob, and the gear teeth on said second gear extend radially outward from a rotation axis of said rotor.

8. A rotary switch comprising: a switch knob; a rotor; contact spring means attached to said rotor; and a transmission attached between said switch knob and said rotor so that rotation of said switch knob through a first angle causes rotation of said rotor through a second angle less than said first angle.

9. The rotary switch of claim 8, wherein said transmission includes speed reduction gears attached between said switch knob and said rotor so that said switch knob and said rotor simultaneously rotate through different angles.

10. The rotary switch of claim 9, wherein said speed reduction gears include a first gear fixedly attached to said switch knob and a second gear fixedly attached to said rotor, said first and second gears engaging each other and having a different number of equally sized gear teeth defining a teeth-number-ratio between said first and second gears.

11. The rotary switch of claim 10, wherein said first gear has less gear teeth than said second gear.

12. A rotary switch comprising:

a switch knob;

a rotor having contact spring means attached to said rotor;

a circuit board having a circuit pattern thereon, said rotor being rotatably mounted to said circuit board so that said contact spring means is selectively movable between and contactable with a plurality of contacts in said circuit pattern; and a transmission attached between said switch knob and said rotor and including a first gear fixedly attached to said switch knob and a second gear fixedly attached to said rotor, said first and second gears engaging each other and having a different number of equally sized gear teeth defining a teeth-number-ratio between said first and second gears, wherein said first gear has less gear teeth than said second gear so that rotation of said switch knob through a first angle causes said rotor to rotate through a second angle less than said first angle.

13. The rotary switch of claim 12, wherein said circuit pattern includes two circuits arranged along a common circumference on said circuit board, each of said two circuits extending along no more than 180° of said common circumference, and said teeth-number-ratio is such that rotation of said rotor through 180° so as to selectively engage said contact spring means with said plurality of contacts in said two circuits is caused by rotation of said switch knob through an angle greater than 180°.

14. The rotary switch of claim 12, wherein an angle between adjacent contacts in said circuit pattern is less than an angle between adjacent positions of said switch knob.

15. The rotary switch of claim 12, wherein the gear teeth on said first gear extend radially outward from a rotation axis of said switch knob, and the gear teeth on said second gear extend radially inwardly toward a rotation axis of said rotor.

16. The rotary switch of claim 12, wherein the gear teeth on said first gear extend radially outward from a rotation axis of said switch knob, and the gear teeth on said second gear extend radially outward from a rotation axis of said rotor.

17. An electronic device including a circuit having a rotary switch, said rotary switch comprising a switch knob; a first gear fixedly attached to said switch knob; a rotor; a second gear fixedly attached to said rotor; and contact spring means attached to said rotor; said first and second gears engaging each other so that said switch knob and said rotor are rotatably attached to each other by said first and second gears, whereby a driving force is transmitted from said switch knob to said rotor through said gears, said first gear having a lesser number of gear teeth than said second gear for an equal angle of rotation of said first and second gears so that rotation of said switch knob through a first angle causes rotation of said rotor through a second angle less than said first angle.

18. A multi-function meter including a circuit having a rotary switch, said rotary switch comprising a switch knob; a first gear fixedly attached to said switch knob; a rotor; a second gear fixedly attached to said rotor; and contact spring means attached to said rotor; said first and second gears engaging each other so that said switch knob and said rotor are rotatably attached to each other by said fist and second gears, whereby a driving force is transmitted from said switch knob to said rotor through said gears, said first gear having a lesser number of gear teeth than said second gear for an equal angle of rotation of said first and second gears so that rotation of said switch knob through a first angle causes rotation of said rotor through a second angle less than said first angle.

19. A rotary switch comprising:

a switch knob; a first gear fixedly attached to said switch knob and having first gear teeth extending radially outward from a rotation axis of said switch knob; a rotor; a second gear fixedly attached to said rotor and having second gear teeth extending radially inward toward a rotation axis of said rotor; and contact spring means attached to said rotor; said first gear located radially within said second gear, and the first and second gear teeth of said first and second gears engaging each other so that said switch knob and said rotor are rotatably attached to each other by said first and second gears, whereby a driving force is transmitted from said switch knob to said rotor through said gears.

20. An electronic device including a circuit having a rotary switch, said rotary switch comprising a switch knob; a first gear fixedly attached to said switch knob and having first gear teeth extending radially outward from a rotation axis of said switch knob; a rotor; a second gear fixedly attached to said rotor and having second gear teeth extending radially inward toward a rotation axis of said rotor; and contact spring means attached to said rotor; said first gear located radially within said second gear, and the first and second gear teeth of said first and second gears engaging each other so that said switch knob and said rotor are rotatably attached to each other by said first and second gears, whereby a driving force is transmitted from said switch knob to said rotor through said gears.

21. A multi-function meter including a circuit having a rotary switch, said rotary switch comprising a switch knob; a first gear fixedly attached to said switch knob and having first gear teeth extending radially outward from a rotation axis of said switch knob; a rotor; a second gear fixedly attached to said rotor and having second gear teeth extending radially inward toward a rotation axis of said rotor; and contact spring means attached to said rotor; said first gear located radially within said second gear, and the first and second gear teeth of said first and second gears engaging each other so that said switch knob and said rotor are rotatably attached to each other by said first and second gears, whereby a driving force is transmitted from said switch knob to said rotor through said gears.

* * * * *